United States Patent [19]

Sump

[11] Patent Number: 4,504,440

[45] Date of Patent: Mar. 12, 1985

[54] PROCESS FOR BONDING REFRACTORY TO SURFACES

[75] Inventor: Cord H. Sump, Chattanooga, Tenn.

[73] Assignee: Combustion Engineering, Inc., Windsor, Conn.

[21] Appl. No.: 535,130

[22] Filed: Sep. 23, 1983

[51] Int. Cl.[3] ..... C22C 33/00

[52] U.S. Cl. ..... 419/3; 419/2; 419/24; 419/34; 419/35; 419/36

[58] Field of Search ..... 228/178; 419/2, 3, 9, 419/24, 34, 35, 36, 37, 64, 4

[56] References Cited

U.S. PATENT DOCUMENTS

| | | | |
|---|---|---|---|
| Re. 30,600 | 5/1981 | Long et al. | 428/118 X |
| 3,390,986 | 7/1968 | Stenerson | 419/36 X |
| 3,811,976 | 5/1974 | Schlömer et al. | 419/36 X |
| 3,916,054 | 10/1975 | Long et al. | 428/116 X |

*Primary Examiner*—Leland A. Sebastian

*Attorney, Agent, or Firm*—Robert L. Olson; Robert L. Olson

[57] ABSTRACT

A process for forming a mat (14) of metal fibers (2) which can be used to hold ceramic material onto the surface of equipment to be protected from heat and corrosion, including the steps of mixing a plurality of metal fibers (2) with polybutene (8) and a finely-divided brazing material (10). This mixture is spread onto a support member (4) having an insulating coating (6) thereon to prevent the fibers from becoming brazed to the support member. The support member containing the fibers thereon is then subjected to a brazing temperature (12), brazing the fibers together to form a loose mat. The mat is then removed from the support member, and reduced (16) in thickness into a more dense mat of fibers. The dense mat (14) is then again subjected to a brazing temperature (18), to form a final product having unusual strength qualities. The dense mat (14), after brazing (18), is formed with dies (19) to a desired shape such as a coating on tubing and either rebrazed to bond to the tubing surface (20) or attached by welding such as stud welding.

7 Claims, 7 Drawing Figures

PROCESS FOR BONDING REFRACTORY TO SURFACES

BACKGROUND OF THE INVENTION

The present invention relates to the support of refractory to protect surfaces from high temperature, corrosive slag which forms complex sulfates, and corrosive acids formed below the dew point of gases. More particularly, the invention relates to the process of forming a supporting framework of strands or fibers of structural material which can be attached to a surface which will effectively hold refractory introduced into interspaces of the framework.

In heat exchange equipment exposed to direct and indirect sources of heat, the temperatures and environment may often require the protection of the surfaces of the equipment by a layer of refractory or other ceramics. The manner in which the refractory is attached to the equipment surface has always been a problem. Because of the different thermal expansion rates between the equipment (metal) and the refractory, and the corrosive nature of the environment, the refractory eventually falls off the surface, or quickly wears out. Another problem is securely attaching or fixing refractory onto surfaces that are not flat or planer, such as rounded or other irregular shapes. My previous patent application U.S. Ser. No. 446,734, filed on Dec. 3, 1982, entitled "A Process For Bonding Refractory To Surfaces", overcomes some of the above problems. That application discloses a process for bonding refractory to a flat surface by first applying a viscous liquid-like vehicle as a coating to strands or fibers of metal, to hold finely-divided brazing material on the surfaces of the strands. A mat of the coated strands or fibers is next spread in a layer over the flat surface or substrate to be protected, and brought to the brazing temperature to form the desired bond. At the brazing temperature forming the bond, the viscous vehicle is evaporated, leaving no residue which deteriorates the quality of the brazing bond of the strands or fibers to each other, and the brazing bonds between the strands or fibers and the substrate.

SUMMARY OF THE INVENTION

The present invention is directed to an improvement in the process set forth in my earlier U.S. patent application Ser. No. 446,734. In the present invention, it is proposed that the bonded metal fiber structure be made separate from any metal substrate. This is done by coating the substrate with a material to prevent brazing of the strand or fibers thereto during the brazing step. The thus formed mat of brazed fibers can then be reduced, by passing it between reducing dies or rolls, to decrease the thickness of, and increase the density of, the mat. The mat can then again be subjected to a brazing temperature, resulting in a mat of brazed fibers of substantial strength and density. This mat can be thereafter shaped and applied to irregular surfaces, for holding refractory thereon.

DESCRIPTION OF THE PREFERRED EMBODIMENT

Figure 1:
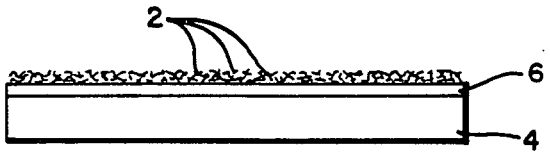
FIG. 1 is a sectional side view of a substrate on which a framework of structural strands are mounted in accordance with the invention.
Figure 2:
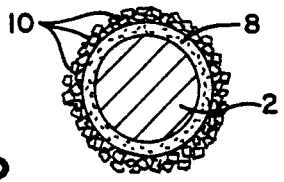
FIG. 2 is a sectional view of the fibers prepared by the process for brazing.

Looking now to FIG. 1, there is shown a plurality of crimped metal fibers 2 randomly spread upon a metal base plate 4. The fiber strands maybe made of any metal, but as mentioned in my earlier application, a stainless steel such as 310 stainless steel Ribtec fibers, is a preferable metal fiber because of its strength and acceptability in present day use in high temperature environments. Certainly the metal used must have a melting temperature higher than the brazing temperature (1700° F. to 222° F.) used in the process. Also, the fibers could be straight rather than crimped, but by placing undulations or bends therein, there is better fiber-to-fiber contact created in the originally formed mat. The undulations or bends can be placed in the fibers by any suitable pressing operation, either before or after the fibers have been cut to proper length. A coating 6 (shown enlarged or exaggerated) of Nicrobraz Stop-off, or any other suitable insulating material, is applied to the plate 4 to form an insulating barrier between the plate and the fibers to prevent the fibers from becoming brazed to the plate when it is subjected to brazing temperature. As shown in FIG. 2, each of the fibers 2 are coated with a liquid-like material 8 which has sufficient viscosity to retain granules of finely-divided brazing material 10 on the fiber surfaces, before they are deposited on the plate. To coat the fibers 2 with the liquid-like material 8, a container is used in which a suitable amount of the liquid-like material, and a suitable amount of the finely-divided brazing material are blended to produce the result illustrated in FIG. 2. The coated fibers are then spread onto the plates, ready to be subjected to the brazing operation illustrated in FIG. 3.

An example of the above materials tested is as follows: 600 grams of crimped metallic fibers were mixed with 48 grams of −325 mesh Nicrobraz 50 powder (brazing material) and 48 grams of Indophol 100 polybutene, were first thoroughly mixed together, and then spread onto the plate 4, with a coating of insulating material thereon. The brazing material can be made up basically of chromium, nickel and phosphorus, but can also contain amounts of other materials, such as carbon, boron, silicon and iron.

Figure 3:
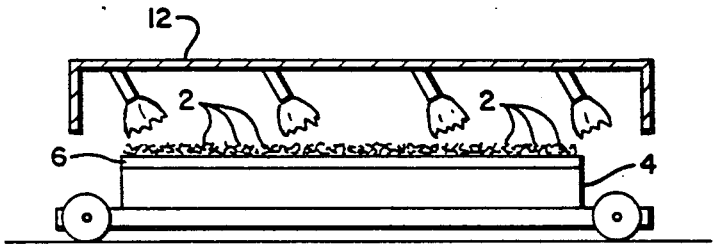
FIG. 3 shows the next step of the process, of subjecting the fibers to a brazing temperature.

The plate 4 with the coated fibers is subjected to brazing heat, such as in a heat treating furnace 1 shown in FIG. 3, where the polybutene is evaporated, and the brazing material is melted. Polybutene is used rather than some other liquid material, since it leaves no residue which might interfere with the brazing of the fibers. The brazing operation is carried out at a temperature in the range of 1700°–2200° F., preferably 1900°–2100° F., for 30 minutes in a hydrogen or other reducing atmosphere. This is a sufficient heat and time to vaporize the polybutene and melt the brazing material. The melting temperature of both the plate and the fibers is considerably higher than the brazing temperature of 2100° F.

Figure 4:
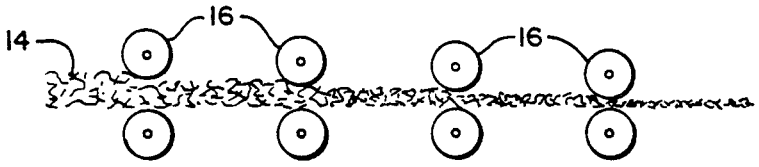
FIG. 4 shows the mat of fibers or strands passing through a plurality of reducing rolls.

After the brazing operation, the mat 14 (FIG. 4) of now brazed-together fibers can be removed from the backing plate 4. The removal is made possible by the intermediate insulating coating 6, which prevented brazing of the fiber to the plate. The mat can then be reduced in thickness, making it more dense, by passing it through a series of reducing rolls 16, or similar reducing equipment, as shown in FIG. 4. On the test sample mentioned above, the mat was originally 0.500 inch thick, and was passed through 4 sets of rolls, having gaps of 0.250, 0.125, 0.060, and 0.030 inches, respectively. The mat was originally 11¼ inches long and 0.500 inches thick. The finished mat was 14¾ inches long and 0.072 inches thick. There was no noticeable change in width. The density increase was thus by about a factor of 10. The original mat was about 7% dense; i.e., the void space was about 93%. Thus in the finished mat the strands occupied about 70% of the space, and the voids 30%. Certainly the amount of reduction of the mat is variable, and different mat densities might be best for holding different ceramic materials.

Figure 5:
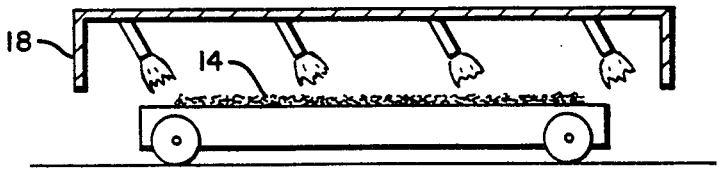
FIG. 5 shows the reduced or more dense mat again being subjected to a brazing temperature.

After the mat has been concentrated by passing through the reducing rolls, it is again subjected to a brazing temperature and a heat treating furnace 18 (FIG. 5). Again, 30 minutes at approximately 2000° F. in a hydrogen atmosphere was used. Again, precautions were taken to prevent the mat from becoming brazed to the support member used to hold the mat in the furnace. The mat is then ready to be shaped to fit a surface to be protected from heat and corrosion, for example in a furnace where fuel is burned. The mat can then be attached to the surface (which can be of any configuration), for example by conventional stud welding techniques, and ceramic material in slurry form can be forced into the voids or interspaces within the mat. After hardening, the ceramic will stay in place for a considerable length of time.

Figure 6:
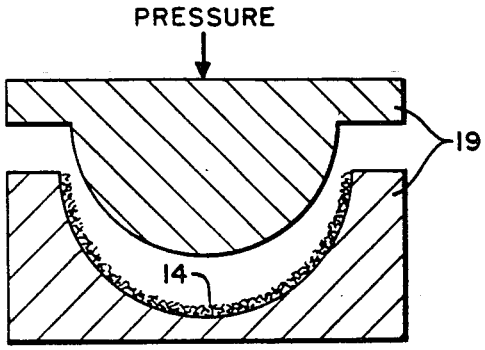
FIG. 6 shows deformation of a mat by die compaction to achieve desired curvature for outside surface of pipe or tubing.
Figure 7:
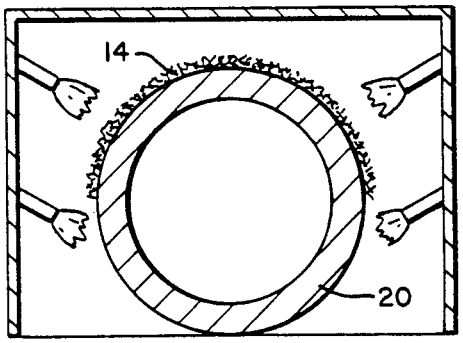
FIG. 7 shows the bonding of the mat after shaping according to FIG. 6 to a pipe or tubing surface by brazing or welding to form the finished product shown in FIG. 1.

The dense mat 14 can be formed with dies 19 (FIG. 6), to a desired shape such as a coating on a tube 20 (FIG. 7) and either rebrazed to bond to the tubing surface or attached by welding such as stud welding.

The strength of the final mat is many times that of the mat originally formed before it is reduced. This is due to a number of factors. First, the mat is considerably more dense, thus increasing its strength. Secondly, when the mat is passed through the reducing rolls, the individual fibers are deformed and bent around each other. Thus when the mat is heat treated the second time, remelting the brazing material, more joints are formed between the fibers, and also joints of larger area of contact are formed. Also, the reducing (a form of cold working) will give the metal fibers some of the benefits that cold working any metal will do. Although the finished mat is intended to be used for holding ceramic material on a surface to be protected, it may also have other beneficial uses, in place of other expanded metal products.

I claim:

1. A process for forming a mat out of metal fibers including dispersing a finely-divided brazing material through a viscous liquid-like material which will decompose during brazing and leave no residue, coating the fibers with the mixture of brazing material and viscous liquid-like material to spread the brazing material evenly over the fibers, forming the coated fibers in a layer over the surface of a support member, the surface of the support member being of such a material that it will not become brazed to the fibers when brazing temperature is applied thereto, placing the coated fibers and support member in an atmosphere having a temperature high enough to decompose the liquid-like material and braze the fibers together into a loosely formed mat, removing the mat from the support member, reducing the thickness of the mat, thereby increasing the density of the mat, and thereafter again placing the mat in an atmosphere having a temperature high enough to again melt the brazing material, rebrazing the fibers together into a more dense mat of unusual strength.

2. The process set forth in claim 1, wherein the viscous liquid-like material is polybutene.

3. The process set forth in claim 1, wherein the atmosphere in both brazing steps is a reducing atmosphere, such as hydrogen.

4. The process set forth in claim 3, wherein the brazing temperatures are in the range of 1700° to 2200° F.

5. The process set forth in claim 3 wherein the brazing temperatures are in the range which causes melting of the brazing alloy used.

6. The process set forth in claim 4, wherein the fibers are exposed to the brazing temperature for approximately 30 minutes during each brazing operation.

7. The process set forth in claim 1 wherein after the densified, rebrazed mat is formed into a desired shape such as a curved section, it can be attached to a substrate by brazing or welding techniques.

* * * * *